US007267289B2

(12) United States Patent
Lyons

(10) Patent No.: US 7,267,289 B2
(45) Date of Patent: Sep. 11, 2007

(54) SHROUDED HOSE FILTER

(76) Inventor: Calvin LaMarr Lyons, 4726 NE. 19th St., Renton, WA (US) 98059

( * ) Notice: Subject to any disclaimer, the term of this patent is extended or adjusted under 35 U.S.C. 154(b) by 0 days.

(21) Appl. No.: 11/197,132

(22) Filed: Aug. 3, 2005

(65) Prior Publication Data

US 2006/0060669 A1 Mar. 23, 2006

Related U.S. Application Data

(60) Provisional application No. 60/599,168, filed on Aug. 4, 2004.

(51) Int. Cl.

| | |
|---|---|
| ***B05B 1/26*** | (2006.01) |
| ***B05B 1/14*** | (2006.01) |
| ***B05B 1/34*** | (2006.01) |
| ***B01D 35/00*** | (2006.01) |
| ***B01D 25/00*** | (2006.01) |
| ***B01D 27/00*** | (2006.01) |
| ***B01D 29/00*** | (2006.01) |

(52) U.S. Cl. ..... 239/461; 239/462; 239/505; 239/524; 210/460

(58) Field of Classification Search ..... 239/461, 239/462, 505, 524, 11, 110, 120–122, 288, 239/288.5, 499, 516, 518, 523, 589, 590; 210/460

See application file for complete search history.

(56) References Cited

U.S. PATENT DOCUMENTS

| | | | | | |
|---|---|---|---|---|---|
| 3,487,944 | A | * | 1/1970 | Tucker | 210/463 |
| 3,638,799 | A | * | 2/1972 | Serowiecki | 210/462 |
| 3,804,258 | A | * | 4/1974 | Okuniewski et al. | 210/460 |
| 3,959,138 | A | * | 5/1976 | Nichols | 210/94 |
| 3,960,733 | A | * | 6/1976 | Van Dieren | 210/460 |
| 3,984,330 | A | * | 10/1976 | Nichols | 210/449 |
| 4,123,361 | A | * | 10/1978 | Marschman | 210/232 |
| 4,906,367 | A | * | 3/1990 | Villagomez | 210/251 |
| 5,312,138 | A | | 5/1994 | Patera et al. | |

* cited by examiner

*Primary Examiner*—Joseph A. Kaufman
*Assistant Examiner*—Darren Gorman
(74) *Attorney, Agent, or Firm*—Black Lowe & Graham

(57) ABSTRACT

A water-deflecting shroud. In one embodiment, the water-defelcting shroud comprises a detachable parabolic shield to confine a rupture from a lint filter disposed within the parabolic shield, the parabolic shield configured to modify the rupture in the direction of the interior of the parabolic shield. A securing component coupled to the parabolic shield is configured to secure the shroud to the lint filter and the lint filter to a hose to deflect the rupture. In another embodiment, the shroud provides a splashguard to prevent the rupture from splashing onto adjacent areas and structures.

5 Claims, 4 Drawing Sheets

SHROUDED HOSE FILTER

PRIORITY CLAIM

This application claims priority to and incorporates by reference U.S. Provisional Application Ser. No. 60/599,168, filed Aug. 4, 2004, as is fully disclosed herein in its entirety.

FIELD OF THE INVENTION

This invention relates generally to filtered water drainage systems.

BACKGROUND OF THE INVENTION

Washing machines or other devices having water effluent or drainage hoses fitted or hooked over into a drainage sink commonly have a lint trap attached to the terminus of the hose hanging over the sink. As lint accumulates into the lint trap, water back pressure is created causing the lint filter to burst. Upon bursting, the water sprays in a wide circumference and onto adjacent floors and sheetrock and other internal structures causing water damage. There is a need for a device to re-direct the water flow from busted lint traps and to keep it confined from adjacent floors and walls.

SUMMARY

A preferred embodiment of the present invention comprises a drain hose assembly having a cup-like shroud attached to a hose terminus such that the interior surface of the shroud enclosing a lint filter deflects and confines water streams bursting from the filter when the filter ruptures. The direction and confinement of the water stream bursts are modified by the configuration of the interior surface of the shroud.

In a preferred embodiment, the water bursts are directed to and confined within a sink. The water deflecting shroud is detachably connected to the hose equipped with the lint filter. The lint filter, upon developing ruptures releases water that deflects inwardly from the shroud and is confined within the sink.

BRIEF DESCRIPTION OF THE DRAWINGS

The preferred and alternate embodiments of the present invention are described in detail below with reference to the following drawings.

DETAILED DESCRIPTION OF THE PREFERRED EMBODIMENT

Figure 1:
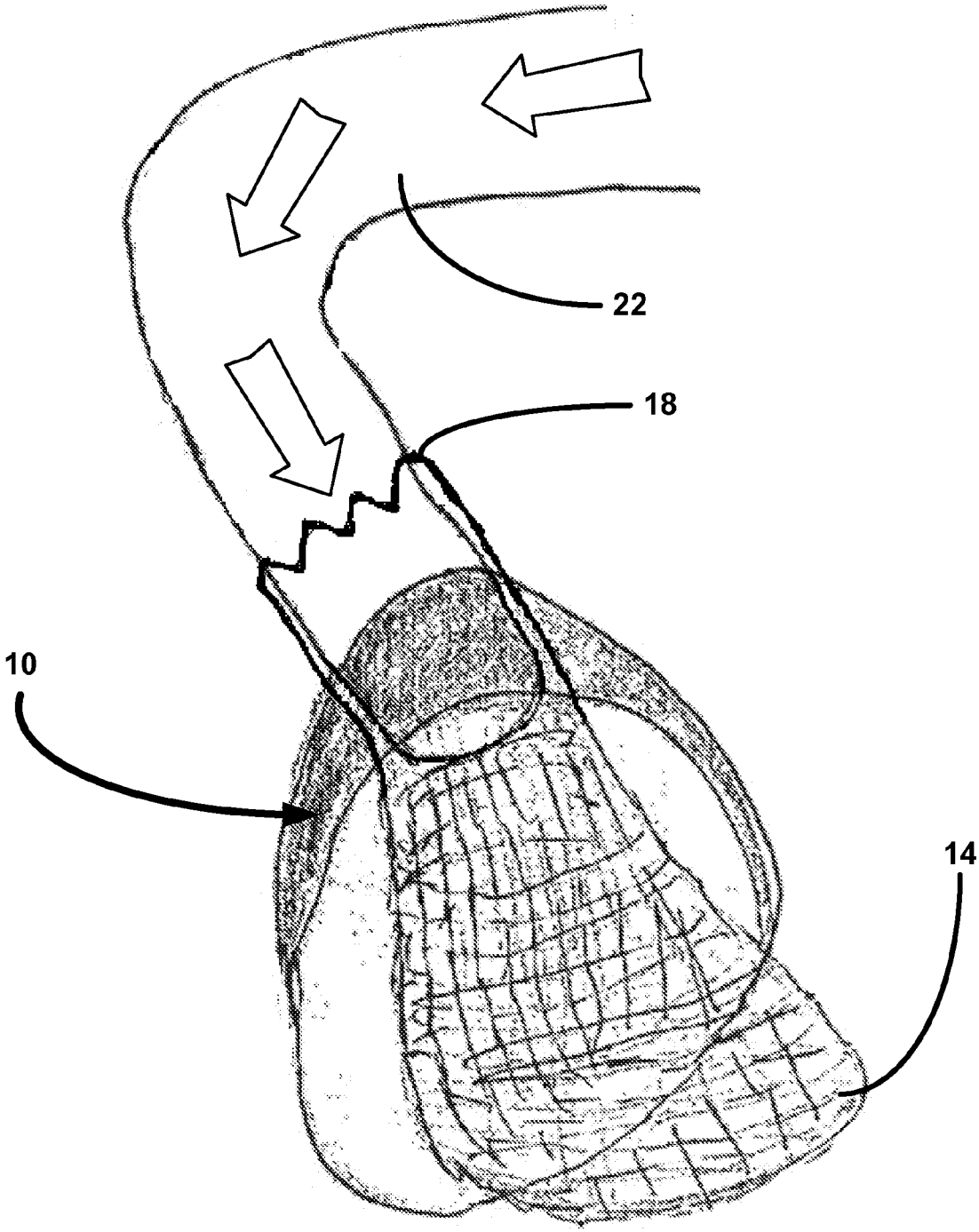
FIG. 1 is a schematic isometric view of a washer hose shroud attached to an effluent water line, according to an embodiment of the present invention.

FIG. 1 depicts a schematic side view of an water hose shroud. In one particular embodiment, the water hose shroud 10 is shown enveloping a lint filter 14 having a filter collar 18 wrapped around the end of a hose 22. Arrows indicate the flow of water through the hose 22 and into the lint filter 14.

The shroud 10 is detachably connected around the collar 18 of the lint screen 14. The shroud 10 aids in the securing of the filter collar 18 of the lint screen 14 to the hose 22 by means of a pinch-like ring (not shown).

Figure 2:
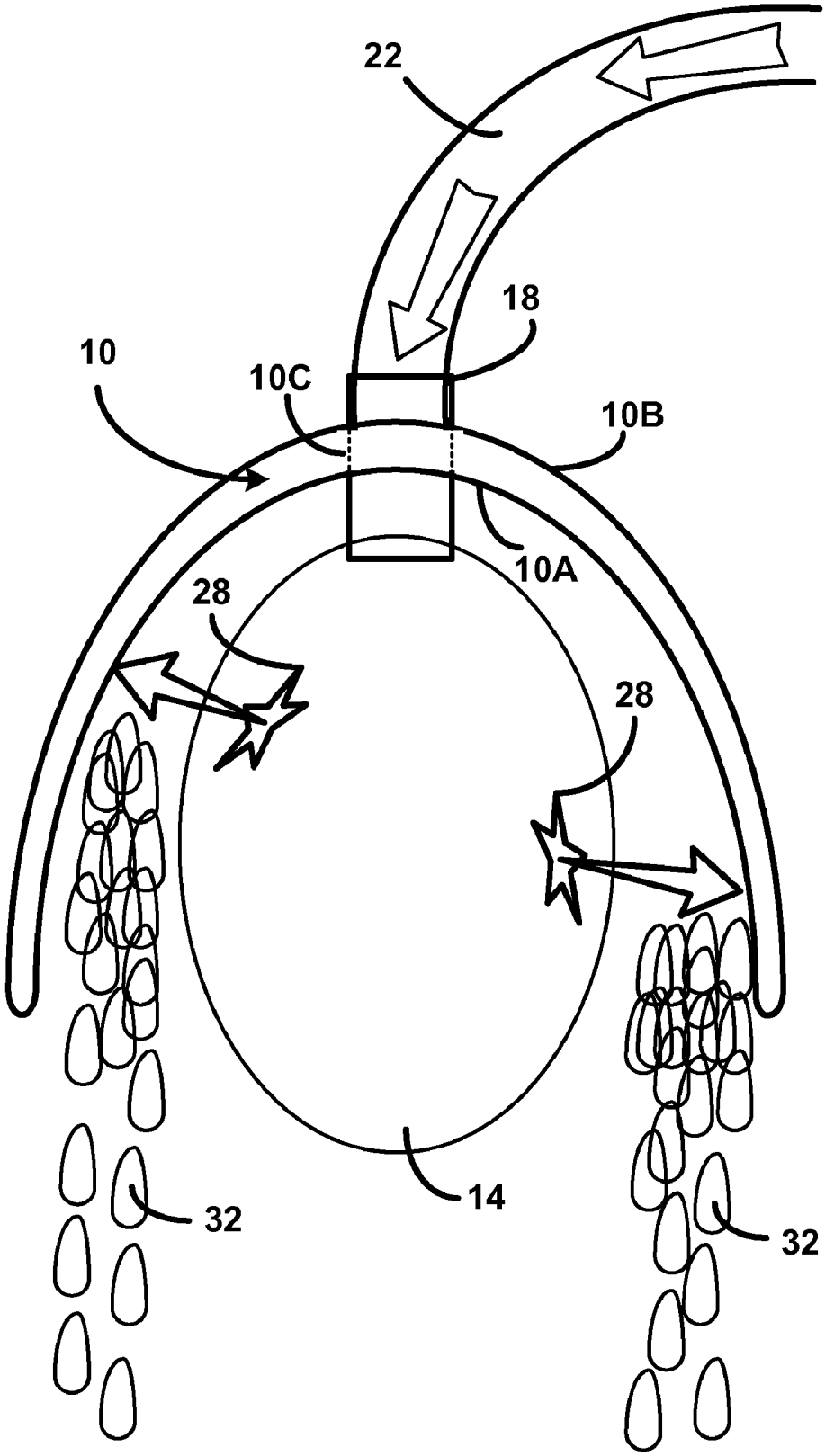
FIGS. 2 and 3 are cross-sectional schematic side views of a shroud, according to another embodiment of the present invention.

FIG. 2 depicts a cross-sectional schematic of a shroud 10. In one particular embodiment, the shroud 10 has an interior side 10A facing the lint filter 14 an exterior side 10B. The shroud 10 further has a shroud aperture 10C (dashed lines). As previously described with reference to FIG. 1, the shroud aperture 10C has a securing means, such as a pinching ring or grommet (not shown). As shown in FIG. 2 a preferred embodiment illustrates shroud 10 having a bell-shaped or parabolic configuration. The shroud 10 is shown engaging with the lint screen collar 18 via the pinching like action of the shroud aperture 10C to secure the lint screen collar 18 to the hose 22. The shroud 10 is secured in a clamping-like action to the hose 14 and thus pinches the collar 18 securely to the hose 22. Arrows inside the hose 22 depict the flow of water into the lint screen 14. In this case, lint has built up inside the lint filter 14 and has caused a pressure increase to create rupture apertures 28 shown in FIG. 2. Water bursting or leaking from the rupture apertures 28 as indicated by the arrows and splash against the interior side of the shroud 10. Water streams that have burst from the rupture apertures 28 are shown dripping downward as a plurality of water drops 32 to the sink below after colliding with and deflecting from the should interior side 10A.

The rupture apertures 28 need not be wide-open rips or gashes in the fabric of the lint filter 14, but may instead take the form of intermediate configurations, including small cracks or narrow tears in the fabric of the filter 14. Alternatively, the rupture apertures may take the form of gaps forming in or between the fabric fibers of the filter 14. If the rupture apertures 28 are wide-open rips or gashes, then the water streams illustrated as water drops 32 can be more voluminous. If the rupture apertures 28 are small cracks or narrow tears, the water streams depicted as water drops 32 may be less voluminous and take on the form of a spray. Whether the water drops 32 form high volume streams or low volume sprays, the interior side 10A of shroud 10 serves to deflect and confine the direction of the streams or sprays emanating from the rupture apertures 28.

When the end of the hose 22 is placed hanging over a sink with the open bell portion of the shroud 10 facing downward towards a sink drain, i.e., the parabola opens down, the shroud 10 serves as a splashguard upon ruptures forming in the lint filter 14. The water streams bursting from the rupture apertures 32 are prevented from splashing onto the floor or adjacent walls, and instead are confined and dire to the sink drain.

Figure 3:
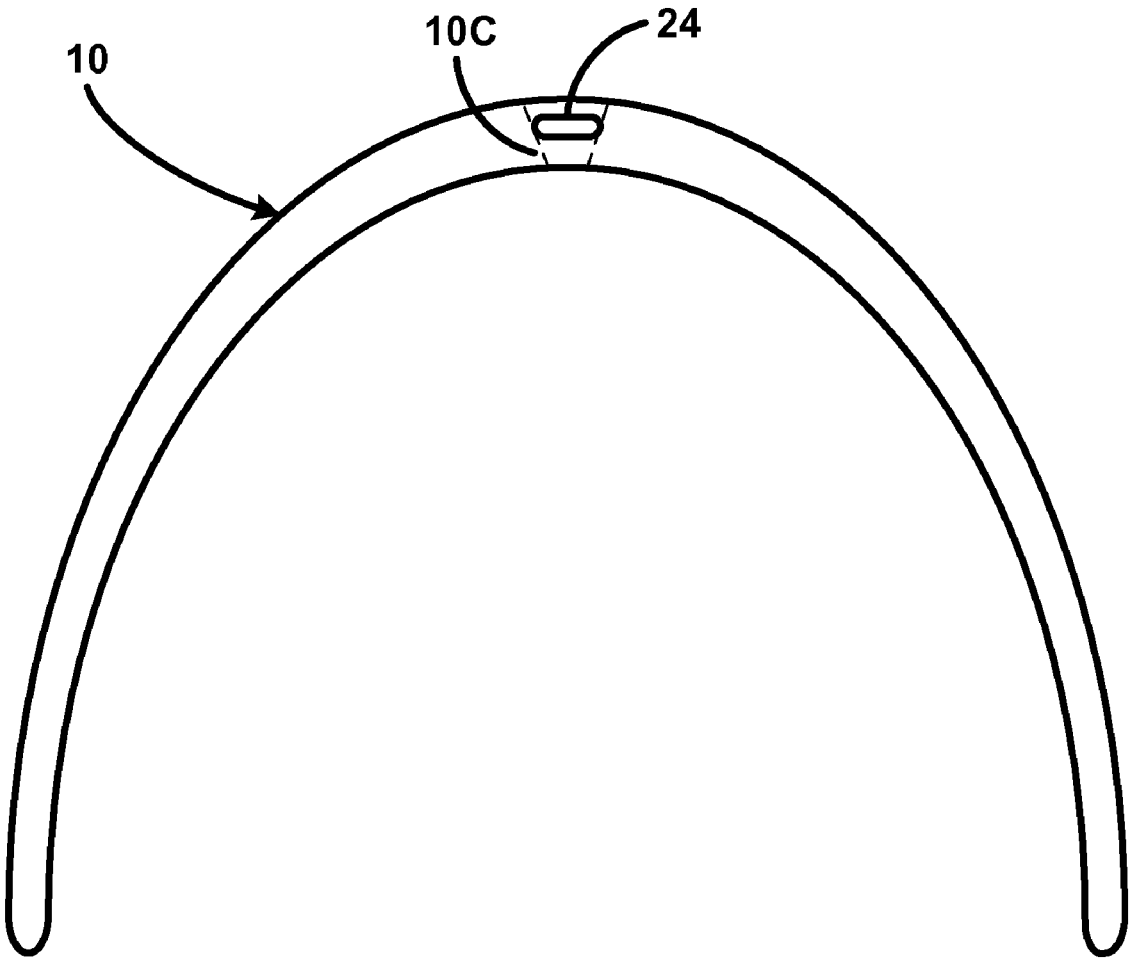

Other preferred embodiments of the shroud 10 may have multiple configurations. For example, the bell-like structure as depicted in FIGS. 1 and 2 may have different parabolic configurations. Moreover, the shroud 10 need not have a cone-like configuration, but instead may be box-like, rectangular, or triangular. The length of the shroud as measured from the shroud aperture 10C engaging with the hose 14 to the bottom of the inner surface 10B may be varied to accommodate different size lint filters. Thus, the parabolic configuration and length of the shroud 10 may be configured to provide the maximum deflection and confinement of the water streams 32 to the sink. FIG. 3 illustrates other preferred embodiments of the shroud 10 include the aperture 10C being slot-like with a narrowing configuration to optimize frictional grabbing and securing of the filter collar 18 to the hose 14. Spanning across the aperture 10C is a pinch ring 24.

Figure 4:
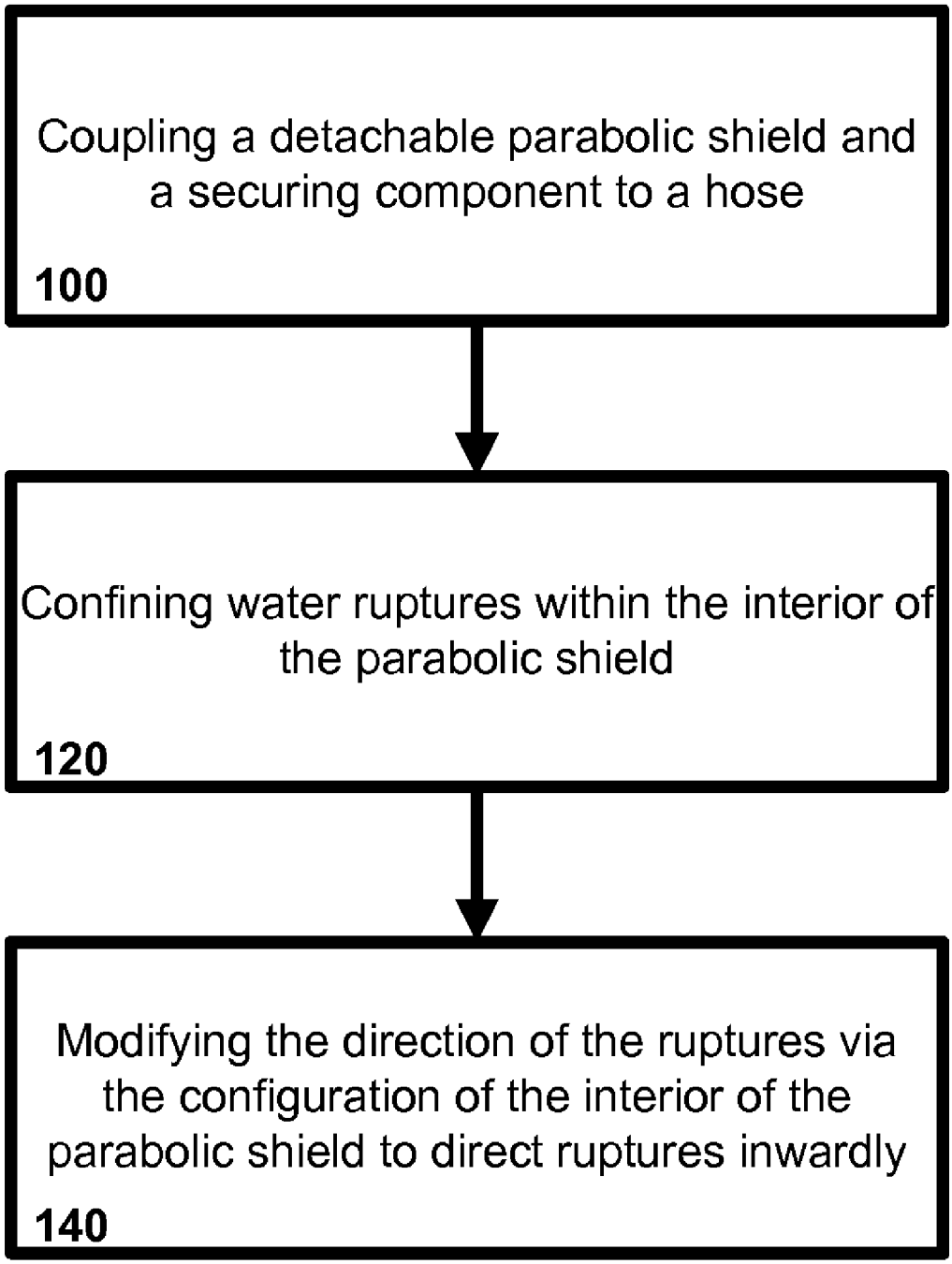
FIG. 4 is a block diagrammatic view of a method of deflecting water, according to yet another embodiment of the present invention.

FIG. 4 illustrates a block diagrammatic view of a method of deflecting water according to an embodiment of the present invention. In one embodiment, at a block 100, a detachable parabolic shield and a securing component are coupled to a hose. At a block 120, water ruptures are confined within the interior of the parabolic shield. As described above, the water ruptures occur where there is an increase in pressure in the lint filter disposed within the parabolic shield. At a block 140, the direction of the ruptures is modified according to the configuration of the interior of the parabolic shield such that the rupture is directed inwardly. In a preferred embodiment, the rupture is redirected so as to confine the splash of the water sprays and streams bursting from the rupture.

Accordingly, the scope of the invention is not limited by the disclosure of the preferred embodiments. Instead, the invention should be determined entirely by reference to the claims that follow.

What is claimed is:

1. A water-deflecting shroud, comprising:

a detachable parabolic shield to confine a rupture from a lint filter disposed within the parabolic shield, the parabolic shield configured to modify the rupture in the direction of the interior of the parabolic shield, and a securing component coupled to the parabolic shield, the securing component configured to secure the shroud to the lint filter and the lint filter to a hose to deflect the rupture.

2. The shroud of claim 1, wherein the parabolic shield comprises at least one of a bell, cone, square, rectangular and triangular shield.

3. The shroud of claim 1, wherein the rupture comprises at least one of a rip, gash, crack, tear and gap in the fabric of the lint filter.

4. The shroud of claim 1, wherein the parabolic shield is further configured as a splashguard component to prevent the rupture from splashing onto an adjacent area, including at least one of a floor and a wall.

5. The shroud of claim 1, wherein the securing component further includes at least one of a pinching ring and a grommet.

* * * * *